US005676120A

United States Patent [19]

Joseph

[11] Patent Number: 5,676,120

[45] Date of Patent: Oct. 14, 1997

[54] MECHANICAL THROWING DEVICE

[76] Inventor: John Gibson Joseph, 3305 C.H. 47, Upper Sandusky, Ohio 43351

[21] Appl. No.: 509,432

[22] Filed: Jul. 31, 1995

[51] Int. Cl.[6] ..... A63B 69/40

[52] U.S. Cl. ..... 124/6; 124/32; 124/36

[58] Field of Search ..... 124/6, 7, 16, 32, 124/36, 41.1, 54

[56] References Cited

U.S. PATENT DOCUMENTS

| | | | |
|---|---|---|---|
| 1,825,882 | 10/1931 | Mauney | 124/6 |
| 2,192,608 | 3/1940 | Butterworth | 124/6 X |
| 3,084,680 | 4/1963 | Goldfarb et al. | 124/16 |
| 3,128,752 | 4/1964 | Andersen | 124/16 |
| 3,610,223 | 10/1971 | Green | 124/16 |
| 3,760,787 | 9/1973 | Kahelin | 124/16 |
| 3,779,227 | 12/1973 | Scott | 124/16 |
| 3,804,071 | 4/1974 | Winrow | 124/16 |
| 4,209,004 | 6/1980 | Kennedy | 124/7 |
| 4,262,648 | 4/1981 | Wegener et al. | 124/32 X |
| 4,784,107 | 11/1988 | Kelly | 124/61 |
| 4,860,717 | 8/1989 | Powell et al. | 124/36 X |
| 4,907,802 | 3/1990 | Gatin | 124/36 X |

*Primary Examiner*—John A. Ricci

*Attorney, Agent, or Firm*—George C. Atwell

[57] ABSTRACT

A mechanical device for throwing projectiles is disclosed which is disposed on a ground surface to throw variously-sized balls to a practicing basketball shooter or a practicing baseball hitter. The device includes an elongated base disposed on the ground surface, a pivoting arm which is attached to the base and which throws the ball, and an electromechanical solenoid whose actuation causes the arm to pivot and throw the ball. When the device is used for basketball practice shooting, a frame is disposed on the ground and around the device, and the frame includes a pole, a backboard secured to the pole, and a rim extending perpendicular from the backboard. A plurality of support arms are attached to the frame, and the arms include an integrally attached net which is disposed around the backboard for collecting thrown basketballs and directing them to the device. When the device is used by practicing baseball hitters, an elongated batting cage is disposed on the ground with the device located at a first end of the cage and the practicing hitter stationed at a second end of the cage in order to hit baseballs thrown by the device. The mechanical device can be further used to throw projectiles, such as aluminum cans, upwardly from the ground and into the air for use as targets by practicing target shooters.

18 Claims, 8 Drawing Sheets

MECHANICAL THROWING DEVICE

BACKGROUND OF THE INVENTION

The present invention relates to ball pitching devices, and more particularly pertains to a mechanical device for throwing projectiles and which is readily adaptable for use in basketball practice shooting, baseball practice hitting, or practice target shooting.

In sports which require a player or players to throw a ball at a target or hit or strike a thrown or pitched ball, it is extremely advantageous for the players to have the means to practice such motions and movements in a constant, repetitive manner to thereby improve their skills. When there are a number of players available, one player can shoot the ball at the target, as in basketball practice shooting, or swing the bat at the pitched ball, as in baseball practice hitting, while the other players cover the court or play the field retrieving errant basketball shots and chasing down hit baseballs. Obviously, during any session of basketball practice shooting or baseball practice hitting, a great deal of time is spent chasing down and retrieving errant basketball shots and hit baseballs.

Moreover, during such practice sessions, it is common that just one basketball or baseball or several basketballs or baseballs at most are used; thus, even with a number of players employed in chasing and retrieving the balls, the continuous and repetitive shooting and hitting movements necessary to improve each player's skills are not achieved. The rhythm of practice is constantly broken by the need to chase and retrieve the basketballs or baseballs.

Therefore, in view of the fact that the players' skills are improved by continuous and repetitive practice, and the elimination of dead time involved in chasing, retrieving and delivering the balls to be thrown or struck increases the amount of practice available for the players, the sports, games and amusements fields have developed numerous systems and devices to continuously deliver balls to practicing players whereupon the players can repetitively throw the balls at a target or strike the balls. Thus, both the intensity of the practice session and the amount of practice time are increased.

The prior art discloses a number of devices which project or throw a succession of balls.

U.S. Pat. No. 3,084,680 (Goldfarb et al.), U.S. Pat. No. 3,128,752 (Andersen), U.S. Pat. No. 3,610,223 (Green), U.S. Pat. No. 3,760,787 (Kahelin), U.S. Pat. No. 3,779,227 (Scott), U.S. Pat. No. 3,804,071 (Winrow), U.S. Pat. No. 4,209,004 (Kennedy), and U.S. Pat. No. 4,784,107 (Kelly) all disclose, in one form or another, devices which fling or project various types of balls, such as tennis balls, volleyballs, baseballs, or basketballs, by pneumatic or mechanical means.

While all of the above devices perform, in one manner or another, the basic function of projecting a ball, the devices are large, bulky, and unwieldy in construction and operation. Furthermore, they are not adaptable for both basketball practice shooting and baseball practice hitting, as well as target practice shooting. Thus, there is a need for a portable ball pitching device which is adaptable for several different purposes, such as basketball practice shooting and baseball practice hitting, and also includes some type of ball return system integrally attached to the ball pitching device.

SUMMARY OF THE INVENTION

The present invention comprehends a mechanical device for throwing projectiles and for assisting practicing players in basketball practice shooting or baseball practice hitting. The device is disposed on a ground surface and includes an elongated base which is set upon and in contact with the ground surface. The base has a front end and a rear end; mounted at the rear end is a switch member and mounted at the front end of the base is a selectively pivotable throwing arm. Secured to the base adjacent the switch member and beneath the arm is an arm throwing means which is actuated by the movement of the switch member from a disengaged state to an engaged state. Actuation of the arm throwing means by the switch member causes the throwing arm to pivot from a projectile loading position to a projectile throwing position whereby the ball is thrown in a predefined trajectory away from the mechanical device and toward the practicing basketball shooter or baseball hitter.

In order to vary the distance and velocity of the ball, a tension spring is utilized so that first spring end is secured to the front end of the base and a second spring end is attached to the arm throwing means. To selectively vary the distance and velocity by which the ball is thrown, the device further includes a spring tension adjustment means attached to the spring. By selectively rotating the spring tension adjustment means, the tension of the spring is compressed or relaxed and, thus, the linear reciprocable movement, or stroke, of the arm throwing means is selectively relaxed or retarded. As a result, the velocity by which the throwing arm pivots is varied and, thus, the trajectory, distance, and velocity by which the ball is thrown can be varied for each throw.

When the device is used for basketball practice shooting, a frame can be utilized to which a basketball support pole is attached and which extends upwardly therefrom. A plurality of support arms are attached to the frame and are selectively disposed about the pole and a basketball backboard which is secured to the upper pole end. The arms include an extensible, upwardly opening, concave-shaped, integrally attached net which collects the thrown basketballs and returns them to the device. Disposed above the throwing portion of the arm is a chute which has an upper open end in registration with the lowest portion of the net and into which the balls drop after they roll down along the net. A lower end opens above, and is aligned with, the throwing portion of the arm, and permits the balls to drop therethrough one after another onto the throwing portion of the arm.

When the device is used for baseball practice hitting, a portable, collapsible and extensible elongated batting cage is disposed on the ground. The batting cage has a first receiving end which encompasses the device and a second open hitting end where the batter stands. Located within the batting cage at the first receiving end is a ball return means which may comprise netting material stretched across and attached to opposed inner sides of the batting cage and a funnel attached to the netting material at a centrally located point, the funnel further directing the baseballs down to the throwing portion of the arm of the device. In place of the switch member, this embodiment uses a foot switch which the practicing baseball hitter steps on to actuate the arm throwing means to pivot the throwing arm to throw the baseball.

It is an object of the present invention to provide a portable, easy-to-operate mechanical ball throwing device which can be quickly set up at a variety of locations both indoors and outdoors for practice basketball shooting or practice baseball hitting.

It is another object of the present invention to provide a mechanical device which can be adapted for use with a frame, support arms attached to the frame and a collapsible and extensible net attached along the support arms and disposed about the backboard and rim for basketball practice shooting, or a batting cage and backstop for baseball practice hitting.

Yet another objective of the present invention is to provide a mechanical device which can be mounted to a support stand and support framework so that the device can hurl projectiles, such as tin or aluminum cans, a substantial distance into the air in order for a practicing target shooter to improve his or her shooting by shooting at the thrown projectiles.

For a more complete understanding of the present invention and for further objects and advantages thereof, reference may now be had to the following description taken in conjunction with the accompanying drawings in which:

DETAILED DESCRIPTION OF THE PREFERRED EMBODIMENT

Figure 1:
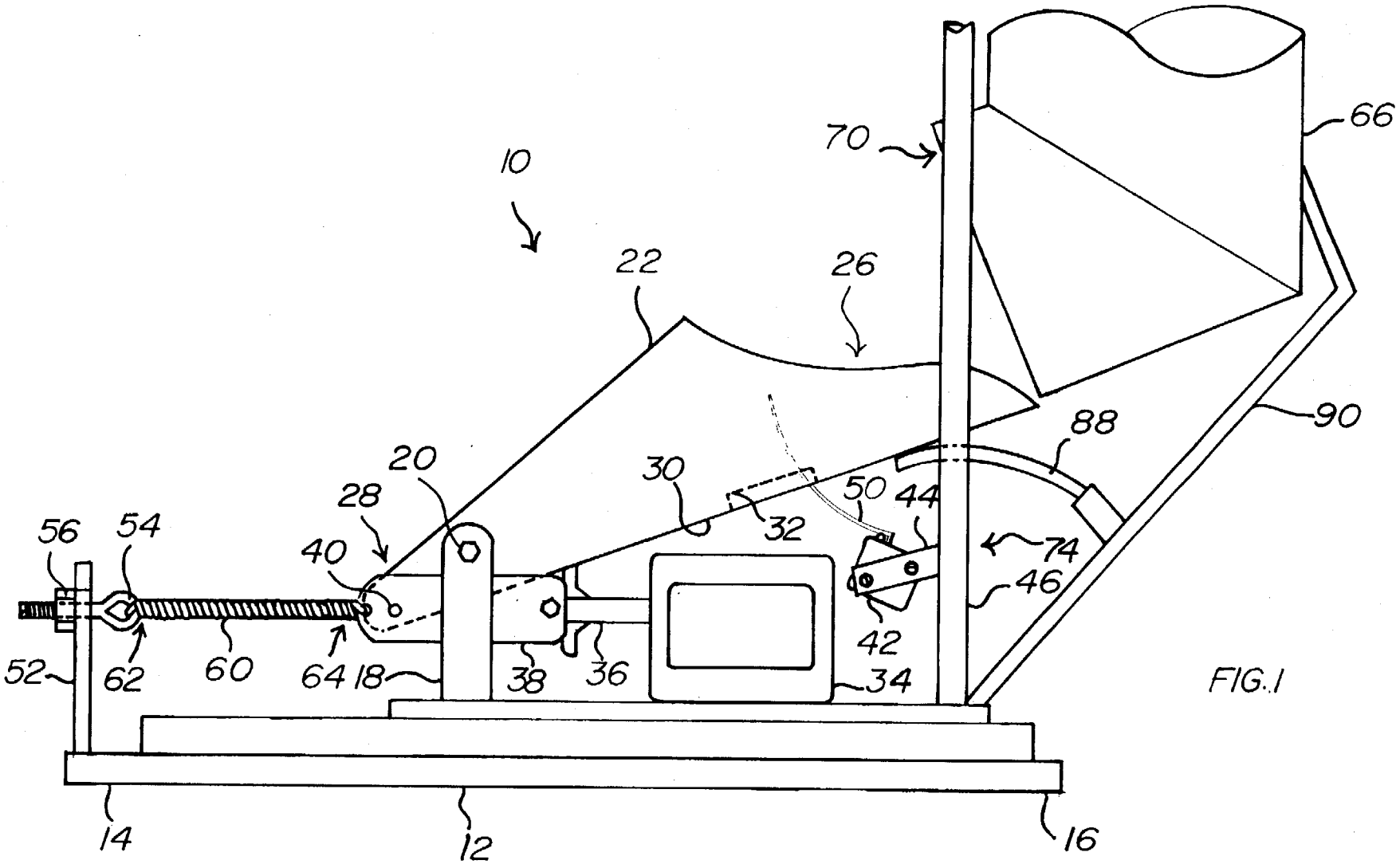
FIG. 1 is a side elevational view of the mechanical device of the present invention illustrating structural components which throw the ball.
Figure 2:
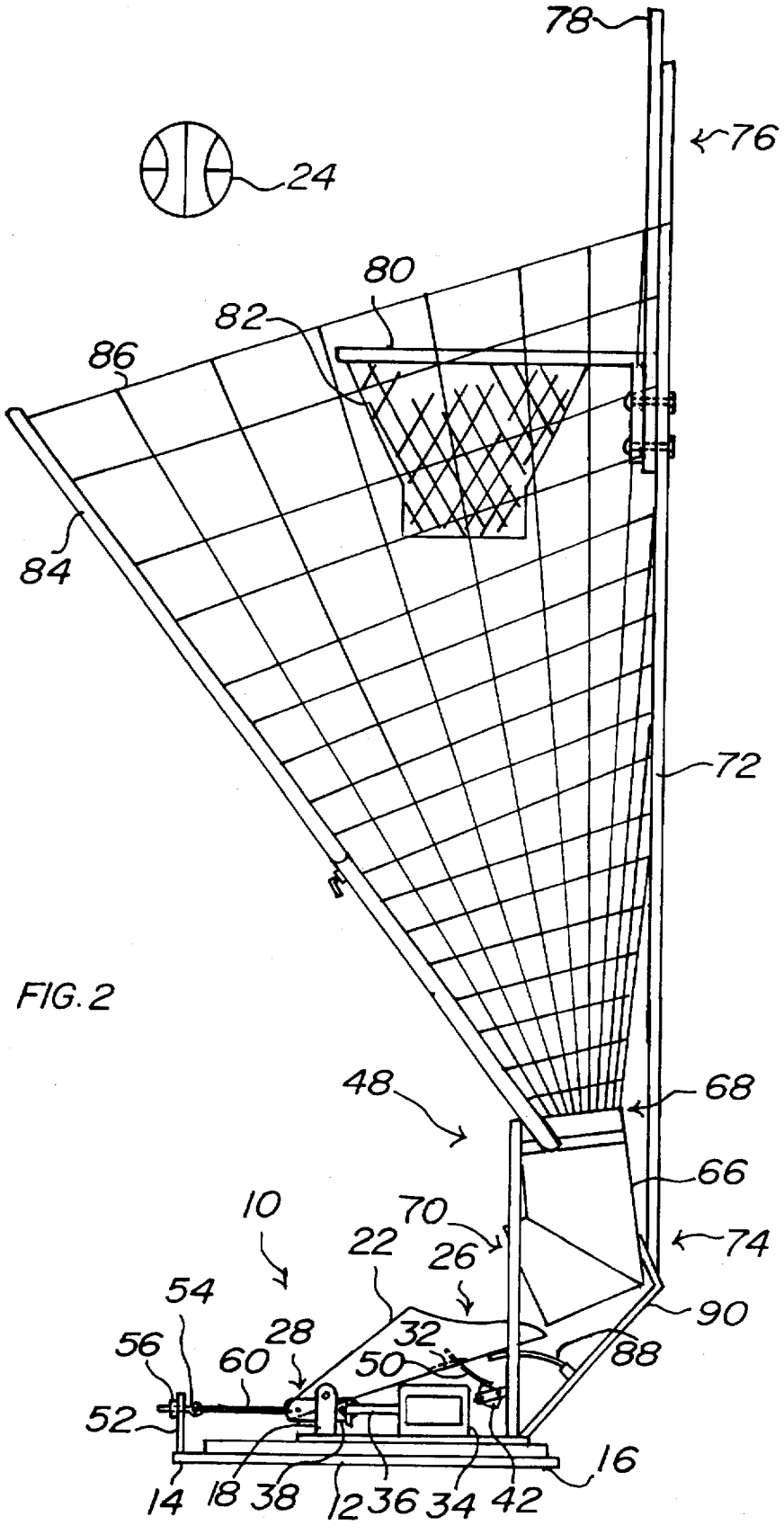
FIG. 2 is a side elevational view of the mechanical device illustrating the basketball practice shooting embodiment.

Illustrated in FIGS. 1–5 is a mechanical device 10 for throwing projectiles in succession, one after another, as the projectiles are received by the device 10. The device 10 is disposed on a ground or floor surface (not shown), and the type of projectile thrown by the device 10 is a smaller version of the standard-sized basketball. The device 10 can be used for amusement as well as for sharpening one's basketball shooting abilities.

As illustrated in FIGS. 1–5, the device 10 includes an elongated base 12 which rests upon the floor surface. The base 12 can be manufactured from a metal or a hard, durable plastic. The base 12 includes a front end 14 and a rear end 16. Secured to the base 12 adjacent the front end 14 and projecting upwardly therefrom are a pair of spaced-apart throwing arm support posts 18. A fastener 20, such as a pin, dowel, or bolt, is inserted through the upper ends of both support posts 18. Rotatably attached to the fastener 20 is a throwing arm 22 which is selectively pivoted from a projectile loading position to a projectile throwing position in order to throw a reduced-sized basketball 24. The throwing arm 22 may be in the configuration of an elongated funnel, as shown in FIGS. 1–5; or the throwing arm 22 may simply be a pair of spaced-apart metal bars attached at one end to the fastener 20 and having a second end in the shape of a circle or oval which can be designated the ball receiving portion.

The throwing arm 22 of FIGS. 1–5, which is in the shape of an elongated funnel, has a projectile receiving portion 26 which is the flared opening of the funnel and an opposite tapered end 28. The fastener 20 is inserted through through-holes (not shown) located at the tapered end 28. The projectile receiving portion 26 shown in FIGS. 1–5, or the throwing arm in the shape of the pair of metal bars in the alternate embodiment, is adapted to receive and temporarily hold the ball 24 as the arm 22 pivots from the loading position to the throwing position during the process of throwing the ball 24. The arm 22 also includes on its undersurface 30 an elongated groove 32 which is approximately three inches long.

As shown in FIGS. 1–5, the device 10 utilizes a throwing means for pivoting the throwing arm 22 from the loading position to the throwing position and back again to the loading position. The pivotal movement of the arm 22 can repeat as long as the individual(s) wish to shoot the ball 24. The throwing means of the present invention is an electromechanical solenoid 34. Solenoids are widely available and sold by a number of manufacturers. They use pull or push action linear motion and come in a wide range of stroke lengths, push or pull rates measured in ounces or pounds, coil resistances, and voltages. The solenoid 34 includes an armature 36 which is capable of extensible and retractable linear reciprocable movement parallel to the base 12 for effecting the pivoting of the throwing arm 22 from the loading position to the throwing position. The selective linear reciprocable movement of the armature 36 provides the force which pivots the throwing arm 22 from the loading position to the throwing position and back again. Attached to the distal end of the armature 36 are a pair of generally oblong-shaped coupling members 38 which are spaced from the base 12 and aligned with the armature 36. The oppositely-disposed through-holes (not shown) at the tapered end of the arm 22 are aligned with each other for receiving a fastener 40, such as a pin or bolt. Each coupling member also includes a distal end which includes a through-hole (not shown) drilled or formed therethrough so that the fastener 40 can be inserted through both through-holes of the coupling members 38 and the through-holes at the tapered end of the throwing arm 22. The tapered end of the arm 22 is disposed between the coupling members 38, thus pivotally attaching the throwing arm 22 to the solenoid armature 36.

In order to energize the solenoid 34 so that pull-action linear movement of the armature 36 pivots the throwing arm 22 to throw the ball 24, the present invention utilizes an actuation means to energize the solenoid 34; and when the solenoid 34 is energized, the armature 36 is retracted for pivoting the throwing arm 22. The actuation means is mounted adjacent the rear end 16 and one component of the actuation means protrudes upwardly toward the throwing arm 22. As will be explained more fully hereinafter, the actuation means is normally in a disengaged state until contact by the ball 24 forces the actuation means to an engaged state.

As shown in FIGS. 1–5, the actuation means is a microswitch 42 mounted to a post 44, and the post 44 is mounted at the rear end 16 of the base 12. In addition, the microswitch 42 can be mounted to an upright post 46 located directly behind the solenoid 34. A frame 48 may be secured to the base 12 or may rest upon the ground surrounding and projecting above the device 10, and the post 46 is part of the frame 48. The frame 48 will be explained in detail hereinafter. The microswitch 42 includes a projectile contact member which is a flexible, thin, hardened wire 50 which projects through the groove 32 of the throwing arm 22. The wire 50 is mounted to the microswitch 42 by a rocker-type means. The wire 50 extends approximately three-fourths of the way up into the funnel of the throwing arm 22 so that it can be contacted by the downwardly rolling ball 24. The microswitch 42 is initially in a disengaged state and keeps the circuit in an open state. When the wire 50 is physically contacted and moved by the ball 24 which has temporarily rolled onto the projectile throwing portion of the throwing arm 22, the physical movement of the wire 50 causes the microswitch 42 to momentarily close the circuit which thus permits energization of the solenoid 34 to cause retraction of the armature 36. The retraction of the armature 36 pivots the throwing arm 22 to throw the ball 24. Once the ball 24 is thrown and no longer engaging the wire 50, the wire 50 automatically returns to its original position causing the microswitch 42 to open the circuit and the solenoid 34 to automatically reset itself and, as a consequence, the armature 36 extends and causes the throwing arm 22 to return to the loading position.

In order to vary the distance and velocity by which the ball 24 is thrown when the throwing arm 22 pivots from the loading to the throwing position, the present invention employs an adjustment means which is mounted to the base 12 adjacent the front end 14. The adjustment means can be manipulated to selectively vary the speed at which the throwing arm 22 pivots from the loading position to the throwing position which thus alters the velocity and distance by which the ball 24 is thrown. The adjustment means includes an upright adjustment member 52 secured to the base 12 adjacent the front end 14, and a bolt 54, such as an eye bolt, inserted through the upper end of the adjustment member 52. A lock nut 56 and washer can then be threaded onto the end of the bolt 54 to fix it in place on the adjustment member 52. Disposed between the bolt 54 and the coupling members 38 is an elongated tension spring 60 having a first end 62 and a second end 64 attached, respectively, to the bolt 54 and the tapered end of the throwing arm 22.

In order to vary the velocity with which the armature 36 retracts, the bolt 54 can be selectively loosened or tightened in its mounting to the upper end of the adjustment member 52. When the bolt 54 is tightened, the tautness of the spring 60 is increased, thus, the retractable linear movement (speed of the stroke) of the armature 36 is retarded which reduces the velocity at which the throwing arm 22 pivots; when the bolt 54 is loosened in its mounting to the adjustment member 52, the tautness of the spring 60 is relaxed, thus, the speed of the retractable linear movement of the armature 36 will increase which will, in turn, increase the velocity at which the throwing arm 22 pivots. The velocity with which the armature 36 retracts and with which the throwing arm 22 pivots to throw the ball 24 can vary continuously across a wide range depending upon such factors as the length of the bolt 54 used, the length and structural characteristics of the particular spring 60 used, the length of stroke of the armature 36, the weight of the arm 22, and the distance between posts 18 and members 52. It should also be noted that the bolt 54, the spring 60, the coupling members 38, and the armature 36 are in general axial alignment horizontal to and spaced from the base 12.

The device 10 can also include an enclosure 65 for placement over the device 10 so as to cover the mechanical parts of the device 10 and provide a safety cover or shield for the device 10. The enclosure 65 will include an upwardly-opening slot for allowing the throwing arm 22 to pivot upwardly therethrough as the arm 22 goes from the loading position to the throwing position and back to the loading position during the process of throwing the ball 24.

As was previously mentioned, the device 10 includes a frame 48 which is used in conjunction with the device 10 to collect and return shot basketballs 24 to the device 10 so that they may be thrown therefrom and returned to the practicing player(s). The frame 48 includes a number of structural elements which facilitate the quick and efficient collection and guiding of shot basketballs 24 to the throwing arm 22 whereupon the balls 24 are immediately thrown back to the practicing player(s). As illustrated in FIGS. 1–5, the frame 48 includes a chute 66 which is disposed adjacent and above the rear end 16 of the base 12 and the chute 66 includes an upper open end 68 and an opposite lower open end 70. The chute 66 may be mounted to the post 46 or supported by structural elements of the frame 48. The lower end 70 is in alignment with, and adjacent to, the projectile receiving portion 26 of the throwing arm 22, and the chute 66 allows passage of basketballs therethrough for placement upon the receiving portion 26. The length of the chute 66 can vary but it should at least accommodate one ball 24 within its linear extension, as shown in FIG. 5. The configuration of the chute 66, post 46, and structural elements of the frame 48 in FIGS. 1–5 discloses one embodiment for mounting the chute 66 above and adjacent to the throwing arm 22; other support means are readily conceivable so long as the lower end 70 of the chute 66 is aligned with and opens to the receiving portion 26.

A pole 72 can be attached to the rear end 16 of the base 12 at a lower pole end 74 and the pole 72 terminates at an upper pole end 76. The pole 72 may also be freely standing for disposition adjacent the rear of the base 12. At the upper end 76 a backboard 78 is secured thereto, and a rim 80 is secured to the backboard 78 and projects perpendicular therefrom. The rim 80—and netting 82—is spaced above the chute 66 and is in general alignment with the upper open end 68 so that balls that pass through the rim 80 will fall down into the chute 66 for passage therethrough to the throwing portion of the arm 22. In addition, structural elements of the frame 48 include a plurality of extensible and retractable support arms (telescoping arms) 84 which are attached to the frame 48 and which are capable of selective disposition above the device 10. The support arms 84 illustrated in FIGS. 1–5 are shown as being disposed in front of the backboard 78 and extending above and over the device 10. However, the frame 48 could include support arms which extend behind the pole 72 and backboard 78 so as to completely surround the rim 80 on all sides. With this configuration, any ball 24 which is thrown over the backboard 78 would still be collected by the frame 48 and directed to the chute 66. In order to collect and direct the shot basketballs 24 to the chute 66 and then to the throwing arm 22, a collapsible and extensible net 86 is attached to the support arms 84, along the length thereof, for disposition above the device 10. The net 86 encompasses the rim 80 and collects the thrown balls 24 and directs them to the chute 66.

Figure 4:
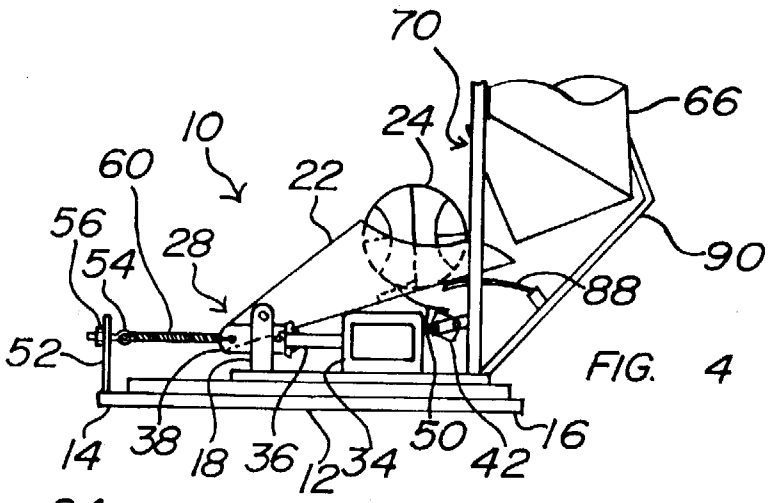
FIG. 4 is a side elevational view of the basketball practice shooting embodiment of the device illustrating the basketball contacting the switch member and momentarily resting on the throwing arm.
Figure 5:
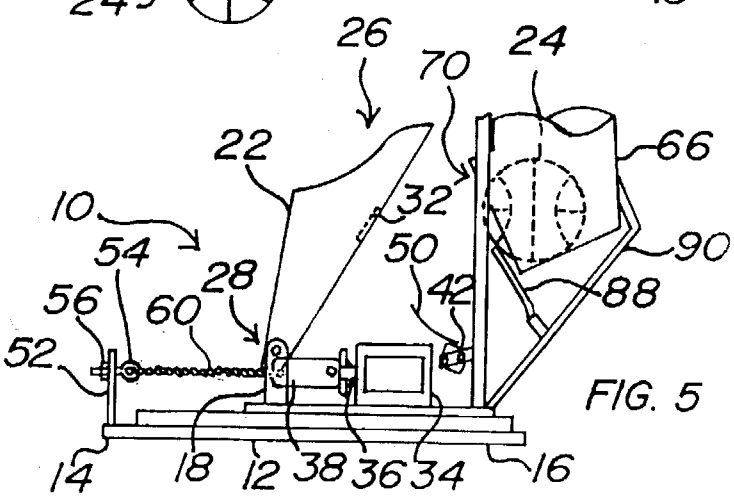
FIG. 5 is a side elevational view of the basketball practice shooting embodiment of the device illustrating the pivoting movement of the throwing arm which throws the basketball.
Figure 3:
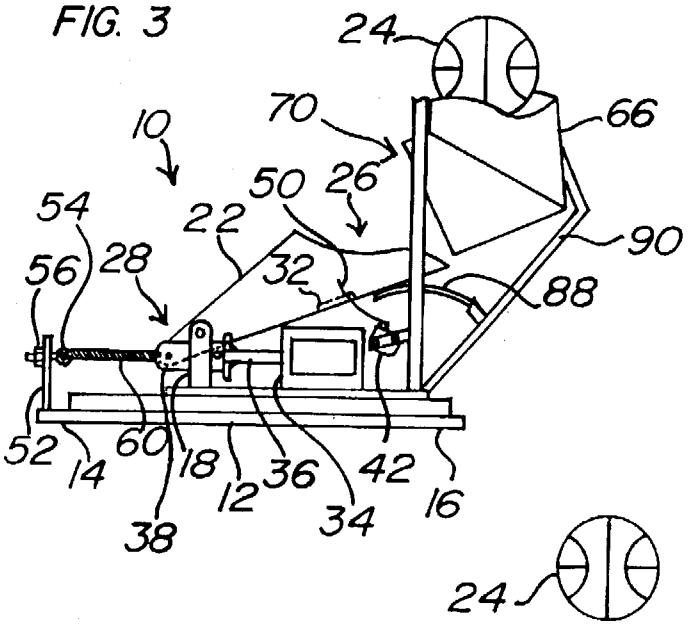
FIG. 3 is a side elevational view of the basketball practice shooting embodiment of the device first shown in FIG. 1 illustrating a basketball descending the funnel.
Figure 5A:
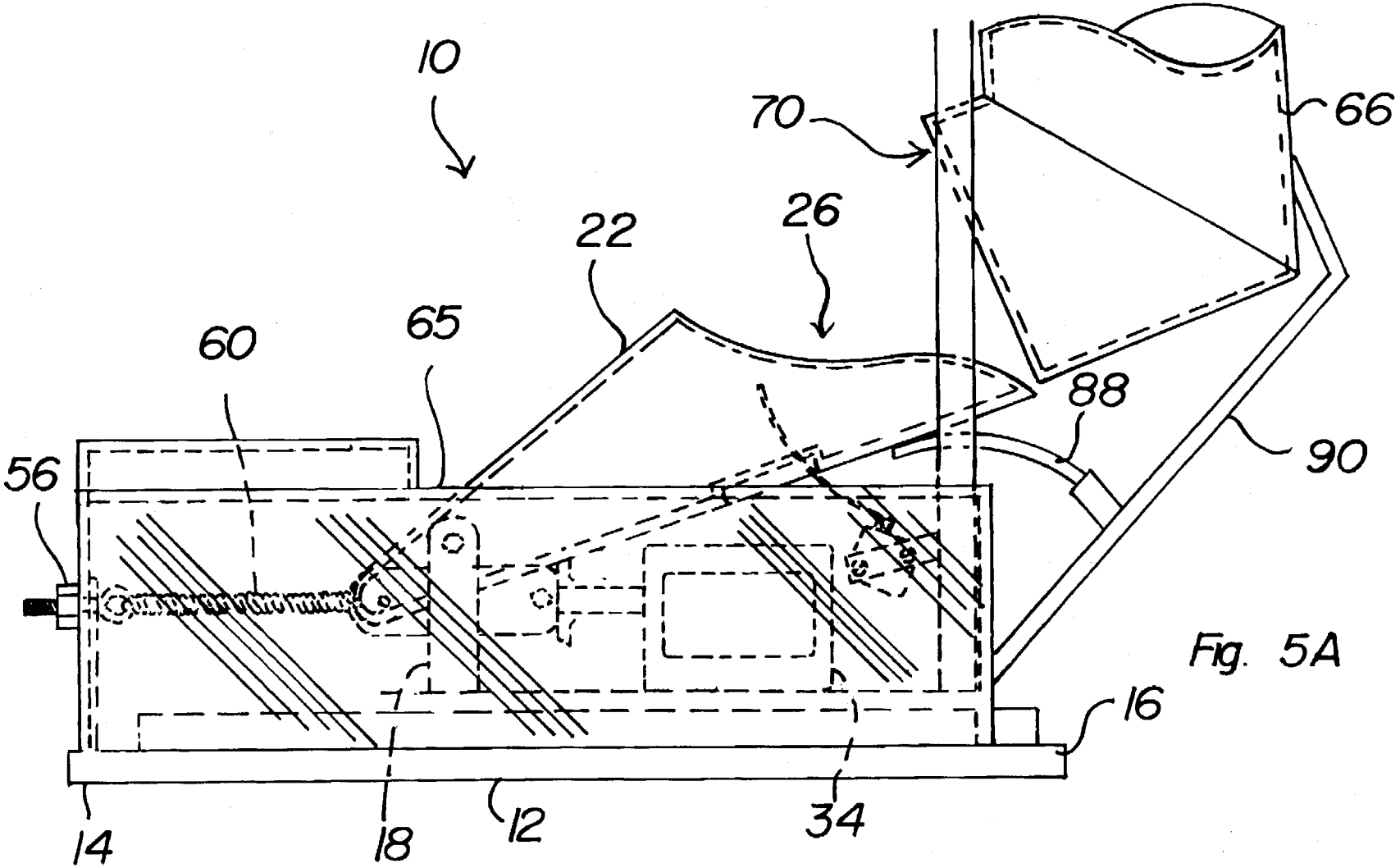
FIG. 5A is a side elevational view of the mechanical device of the present invention illustrating the enclosure for the device.
Figure 5C:
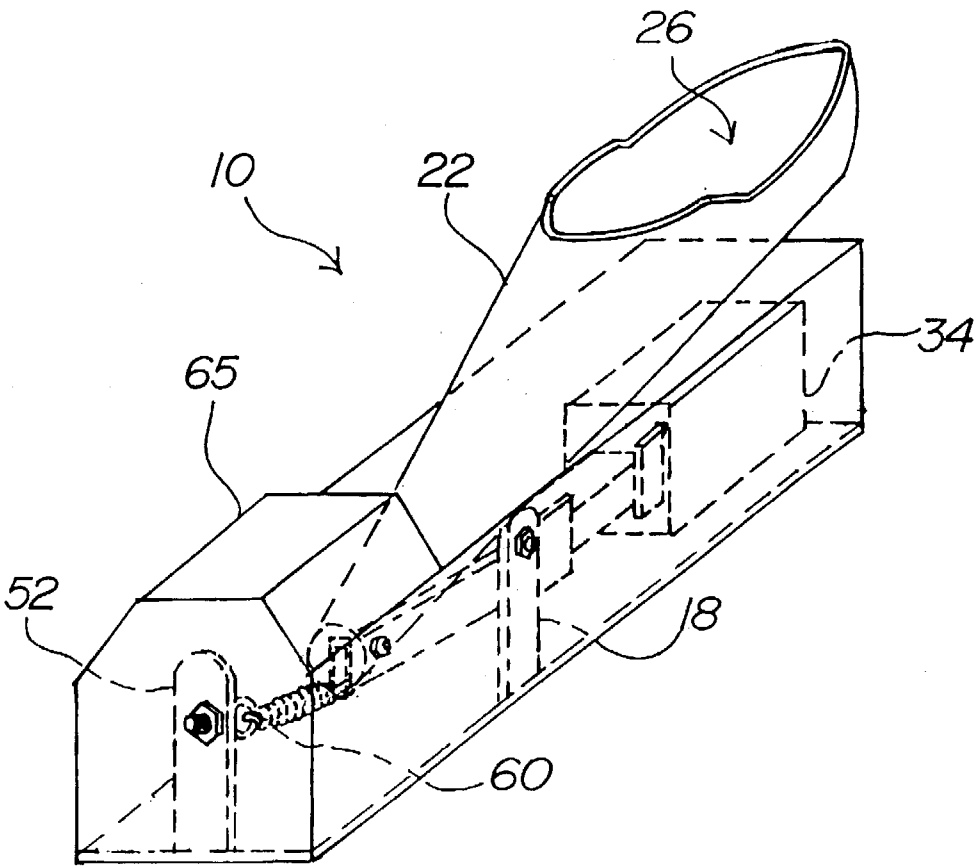
FIG. 5C is a perspective view of the mechanical device of the present invention illustrating the enclosure for the device.
Figure 5B:
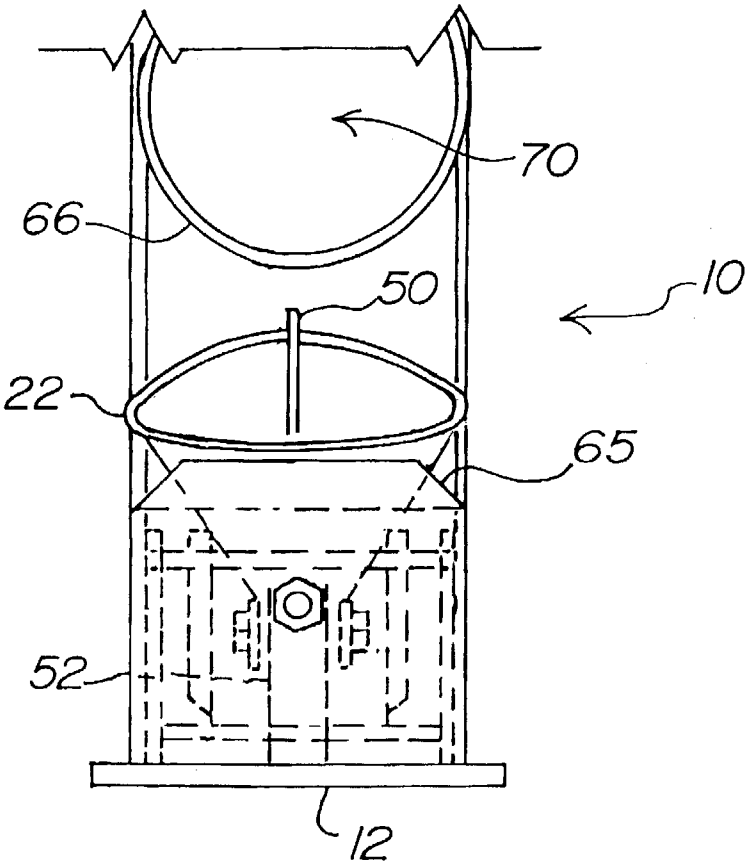
FIG. 5B is a front elevational view of the mechanical device of the present invention illustrating the enclosure for the device.

With reference to FIGS. 3–5, the process by which the ball 24 is thrown by the device 10 will now be set forth. As shown in FIG. 3, the ball 24 is descending through the chute 66 for egress at the lower end 70. The throwing arm 22 is in the projectile loading position so that the receiving portion 26 is adjacent the open lower end 70 and the armature 36 is in its extended position. As shown in FIG. 3, when the throwing arm 22 is in the projectile loading position it contacts and depresses a flexible plastic finger 88 which is attached to an angled support member 90 which is a structural element of the frame 48. The support member 90 is secured to the rear end 16 of the base 12 and helps support the chute 66. Furthermore, in the embodiment shown in FIG. 2, the pole 72 is secured to the support member 90. The finger 88 is several inches long and flexes downward when the undersurface 30 of the throwing arm 22 adjacent the receiving portion 26 contacts and presses down on the finger 88. The finger 88 must have a length sufficient to extend several inches up past the lower end 70 when the finger 88 is in its unflexed state. As shown in FIG. 3, when the throwing arm 22 is in the loading position, the wire 50 of the microswitch 42 extends upward through the groove 32 of the funnel and into the hollow of the funnel adjacent the receiving portion 26 of the arm 22. The position of the device 10 shown in FIG. 3 will be maintained for the length of time it takes one ball 24 to descend through the chute 66 for momentary placement upon the receiving portion 26 of the arm 22.

FIG. 4 illustrates the next stage in the throwing of the ball 24 by the device 10. The ball 24 has now traveled through the chute 66 and rolled into the receiving portion 26 where it comes to a halt. Simultaneous with the ball 24 rolling into the receiving portion 26, the ball 24 contacts and physically displaces the wire 50. The physical displacement of the wire 50 causes the microswitch 42 to close the electrical circuit which thus electrically energizes the solenoid 34 to retract the armature 36. The swift and forceful linear retraction of the armature 36 causes the throwing arm 22 to immediately pivot and throw the ball 24 as shown in FIG. 5. As the ball 24 is thrown by the upward, pivotal movement of the throwing arm 24, the ball 24 no longer contacts the wire 50 and the wire 50 thus returns to its disengaged state which causes the circuit to open and the solenoid 34 to automatically reset itself. Simultaneous with the upward pivotal movement of the throwing arm 22 to throw the ball 24, the finger 88 flexes backward to block the lower end 70 of the chute 66 which prevents the next ball from rolling through the lower end 70 before the arm 22 has returned to the loading position. Resetting of the solenoid 34 causes the armature 36 to extend which thus causes downward pivotal movement of the throwing arm 22. As the throwing arm 22 returns to the loading position, the tip of the funnel at the projectile throwing portion 26 catches the upright finger 88 and causes the finger 88 to flex to the position shown in FIG. 3. All of the above-described actions take place within the span of only a few seconds and can therefore be considered for all practical purposes simultaneous with each other. Because the solenoid 34 automatically resets itself each time the throwing arm 22 flings the ball 24, a succession of balls 24 can be shot at the rim 80 and returned in succession to the player(s) by the action of the throwing arm 22.

Figure 13:
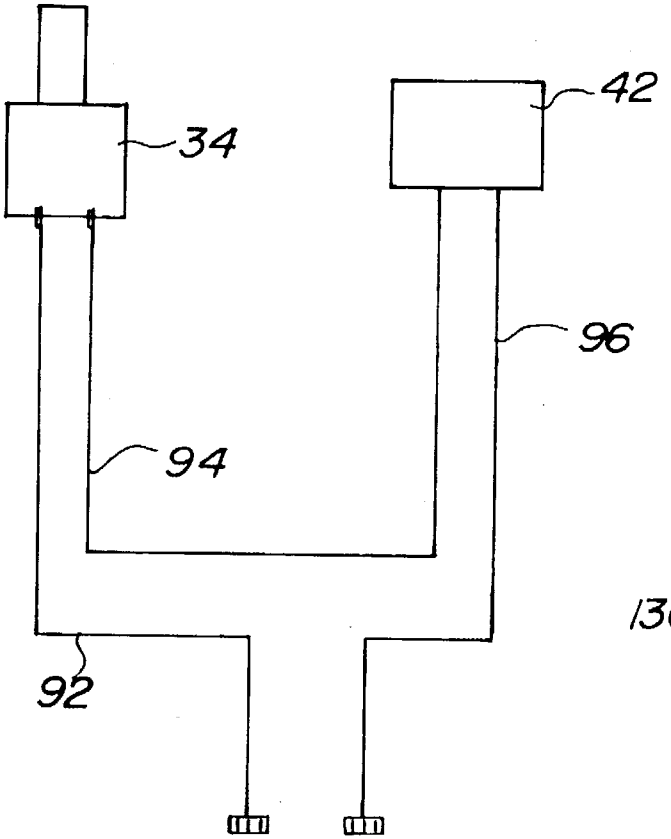
FIG. 13 is an electrical schematic of the device first shown in FIG. 1.

The device 10 can be run off standard 110 volt household current and the solenoid 34 can include two flat terminals (not shown) on its body. As shown in FIG. 13, electrical conductors 92 and 94 to a wall outlet and the microswitch 42, respectively, would be soldered together at their ends, covered with a small rubber terminal covering and attached to the respective terminals. The microswitch 42 will also have an electrical conductor 96 which will be plugged into an electrical outlet, such as a wall or outdoor receptacle.

Figure 7:
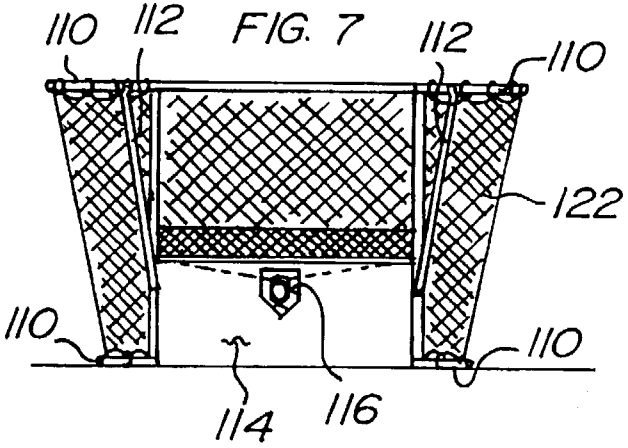
FIG. 7 is a front elevational view of the baseball practice hitting alternative embodiment of the mechanical device.
Figure 6:
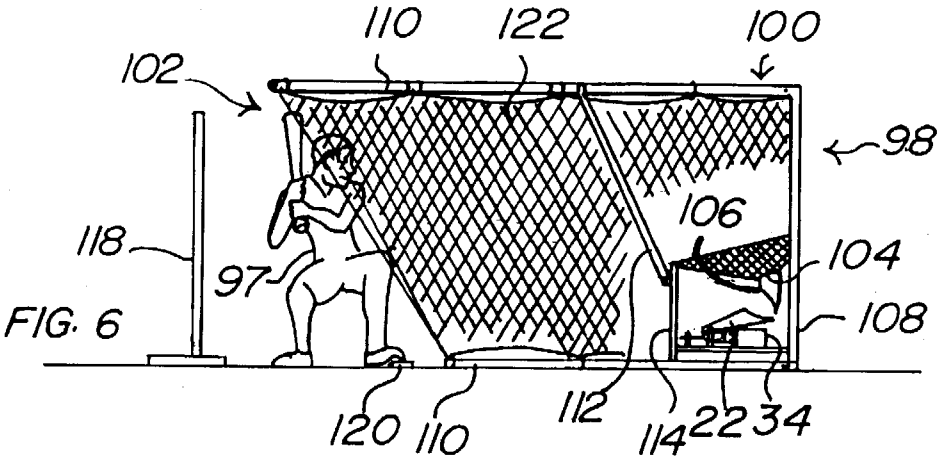
FIG. 6 is a side elevational view of the baseball practice hitting alternative embodiment of the mechanical device.
Figure 8:
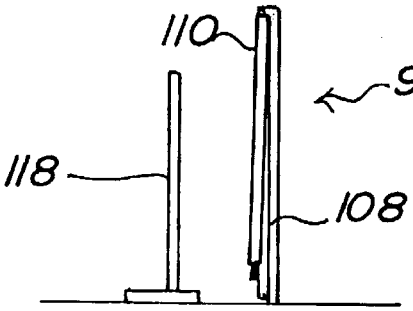
FIG. 8 is a side elevational view of the baseball practice hitting embodiment first shown in FIG. 6 illustrating the batting cage in its collapsed disposition.

Illustrated in FIGS. 6–8 is an alternative embodiment for the device 10 shown in FIGS. 1–5. In FIGS. 6–8, the device 10 is used for baseball practice hitting, and to faciliate baseball practice hitting, several additional structural elements must be used in conjunction with the device 10. In addition, a slight modification must be made to the device 10 in order to permit a continuous session of practice hitting whereby the practicing player(s) can continually cause the device 10 to throw balls so that they can be struck by a practicing baseball batter 97. As shown in FIG. 6, a batting cage 98 is disposed on the ground surface completely enclosing the device 10. The batting cage 98 has a first pitching end 100 where the device 10 is located and a second open hitting end 102 so that baseballs flung by the device 10 can pass therethrough in their path of travel toward the batter.

The batting cage 98 will include some manner of ball return means which will collect and funnel the balls to the device 10. The ball return means illustrated in FIGS. 6 and 7 includes interior netting material 104 attached to the batting cage 98 adjacent the first receiving end 100 and which is stretched across the interior of the batting cage 98 from one side to the opposite side. The netting material 104 is used to collect and funnel hit baseballs to the device 10. A mechanical feeder system can also be disposed within the batting cage 98 so that the netting material 104 can be connected to the mechanical feeder system. The ball return means illustrated in FIGS. 6 and 7 is a simplified example or configuration to return hit baseballs to the device 10; the feeder system and the netting material 104 could be disposed in other configurations so long as the baseballs were funneled to the device 10.

The ball return means shown in FIGS. 6 and 7 does not use a mechanical feeder system. Instead, the netting material 104 is stretched across the interior of the receiving end 100 of the batting cage 98 and a funnel 106 is attached to and disposed beneath the netting material 104 so that the lower end of the funnel 106 opens up to the receiving portion 26. An opposite upper funnel end connects to the netting material 104, and only one baseball at a time can pass through the funnel 106. However, a number of baseballs can gather on the netting material 104 adjacent the upper funnel end and, as the baseballs roll downward on the netting material 104, their jostling allows one baseball to roll into and through the funnel 106.

The batting cage 98 includes a plurality of upright posts 108 which are disposed on the ground surface and a plurality of horizontally-disposed, elongated support members 110.

In addition, a plurality of intermediate support members 112 are included which help maintain the support members 110 in their horizontal extension. The support members 110 are capable of selective linear extension and retraction so as to allow the batting cage 98 to be stored as a compact folded-up unit as shown in FIG. 8. The support members 108, 110, and 112 can all telescope within each other to allow for the compact folding of the batting cage 98 for storage and transportation. Because the batting cage 98 is capable of selective extension and retraction along the ground, the practicing batter(s) 97 can be positioned at varying distances from the device 10, and this permits the practicing batter(s) 97 to improve their timing and the quickness of their swing. The closer the batter 97 is positioned to the device 10, the less time he will have to swing at the thrown ball, while the farther away the batter 97 is from the device 10, the more time he will have to judge the position of the ball and to swing at the ball. The batting cage 98 also includes a plastic or vinyl covering or canvas 114 which stretches across the interior of the cage 98 in front of the device 10 when disposed in its operative position. The canvas 114 includes a centrally-located slot 116 through which baseballs are thrown by the device 10. The canvas 114 is connected to the sides of the batting cage 98 and protects the device 10 from being struck and damaged by baseballs hit by the batter(s) 97. The device 10 must be adjusted so that the throwing portion of the arm 22 at its maximum upward position is aligned with the slot 116 in order for the baseballs to pass cleanly therethrough as they are thrown by the arm 22.

To prevent the need for continually chasing balls that are flung by the device 10 and missed by the swing of the batter 97, an upright backstop 118 is disposed on the ground surface behind the batter 97 and adjacent the open hitting end 102 of the batting cage 98. The backstop 118 simply blocks the further travel of balls which are thrown by the device 10 and which are not struck by the batter(s) 97. The backstop 118 should be spaced behind the batter 97 a sufficient distance to allow the batter 97 a full and complete swing of the bat without striking the backstop 118.

The actuation means of the baseball practice hitting embodiment will be a foot switch 120 electrically connected to the solenoid 34. The foot switch 120 will substitute for the microswitch 42 of FIGS. 1–5 and 13, and will be placed on the ground surface adjacent to the position of the batter 97. In order to cause the throwing arm 22 to hurl a baseball, the batter 97 will simply step on the foot switch 120. Stepping on the foot switch 120 will electrically energize the solenoid 34 to cause retraction of the armature 36, causing the throwing arm 22 to pivot and throw the baseball. As in the basketball practice shooting embodiment, the throwing arm 22 will automatically return to the loading position once the batter 97 removes his foot from the switch 120. Although FIG. 13 is an electrical schematic diagram illustrating use of the microswitch 42 with the device 10 in place of the foot switch 120 illustrated in FIGS. 6–8, the switch 120 can be substituted for switch 42 and FIG. 13 would still be accurate.

In order for the practicing baseball batter(s) 97 to use the baseball practice version of the invention, the batter(s) 97 must first find a suitable surface area on which the batting cage 98 and backstop 118 can be disposed. A level expanse, such as a backyard, the pavement of an outdoor playground, or the floor of a gymnasium, would each comprise a suitable surface. The upright posts 108 would then be disposed on the ground surface and the horizontal support members 110 would then be extended to the desired length so that the netting 122 which is attached to the posts 108 and horizontal members 110 can be disposed as a consequence of the extension of the horizontal support members 110. The netting material 104 is then appropriately disposed within the receiving end 100 of the batting cage 98 and the device 10 is appropriately positioned on the ground surface, or on a platform or on horizontal rails or bars, and behind the canvas 114 so that the throwing arm 22 is immediately below the funnel 106 which is attached to the netting material 104. In the alternative, the mechanical feeder system would be placed inside the batting cage 98 behind the canvas 114 and on the ground. The netting material 104 would then be attached to the feeder system so that hit baseballs first strike the netting material 104, roll down to the feeder system, and are then directed from the feeder system to the throwing arm 22.

The batter(s) 97 then determine where the backstop 118 should be placed so as to provide enough room for them to swing their bats at the thrown baseballs, and then the foot switch 120 should be placed adjacent to the position where the batter(s) 97 will stand so that the foot switch 120 can be easily stepped on by the batter(s) 97. The electrical wires 92 and 96 are plugged into the appropriate outlets, as illustrated in FIG. 13, and then one or more baseballs are loaded into a funnel which is part of the feeder system so that, one after another, the baseballs can travel from the funnel to the projectile throwing portion 26 of the throwing arm 22 whereupon each baseball, in turn, is thrown when the foot switch 120 is stepped on. If the feeder system is not used, the baseballs would be placed on the netting material 104 and would fall down through the funnel 106 for deposition, one after another, on the throwing arm 22.

With the batting cage 98 disposed on the ground and the backstop 118 placed an appropriate distance behind the position where the batter(s) 97 will stand, the batter 97 can then step on the foot switch 120 and prepare to swing at the thrown baseball. This process of stepping on the foot switch 120 and swinging at the baseball thrown by the device 10 can continue as long as the batter(s) 97 wish to practice.

Referring to FIGS. 9–14, a second alternative embodiment for the mechanical throwing device 10 is shown. This embodiment is used to throw projectiles, such as the projectiles 124 shown in FIGS. 9, 10, and 12, a substantial distance into the air so that the projectiles 124 can be used as targets for practice target shooting. In effect, the embodiment shown in FIGS. 9–14 would be used in a manner analogous to skeet shooting whereby projectiles 124, such as tin or aluminum cans, would be hurled into the air, one after another, and shot by individuals using shotguns—or other types of firearms—in order to practice their shooting ability.

Figures 9, 10, 11:
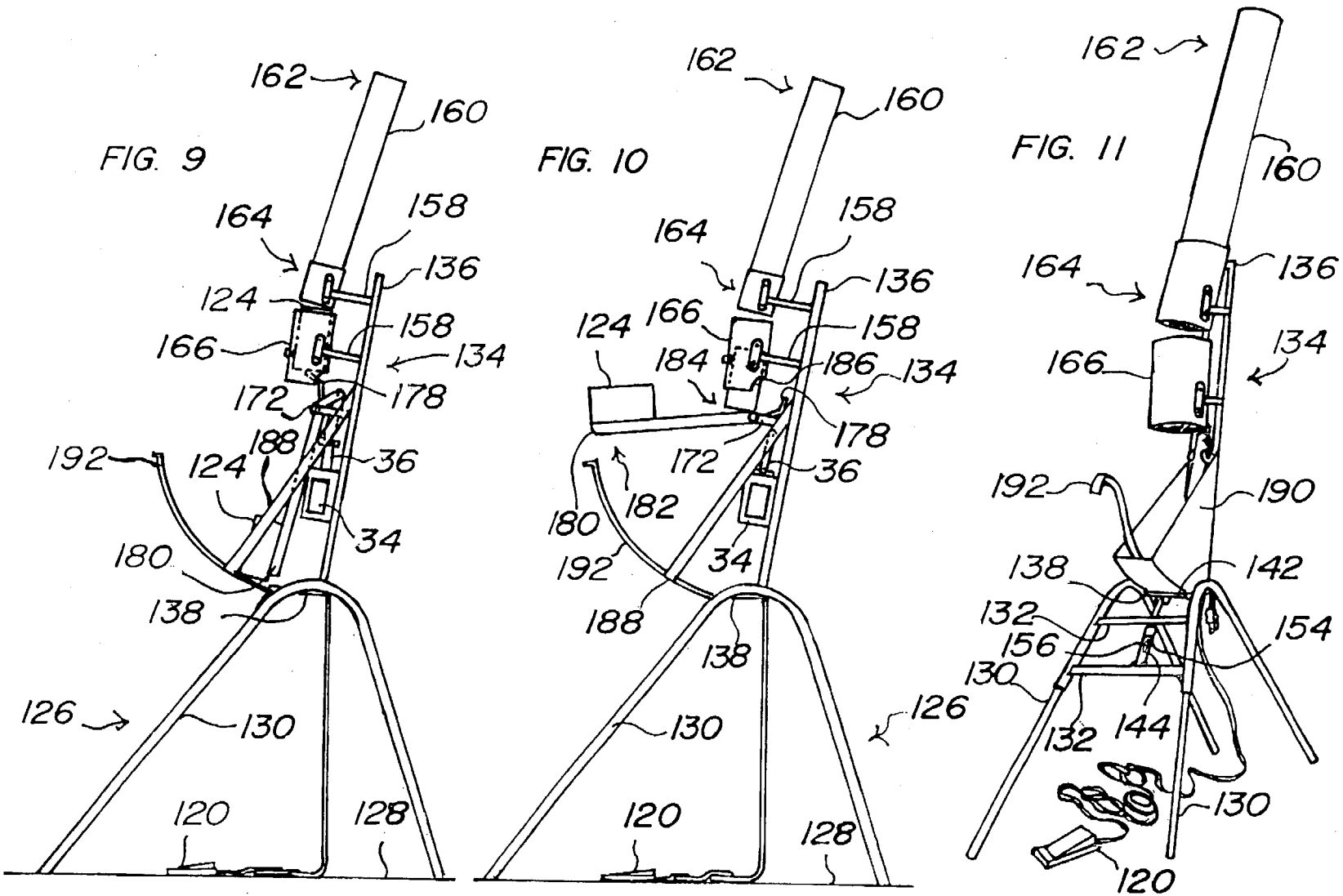
FIG. 9 is a side elevational view of the second alternative embodiment of the mechanical throwing device illustrating its use for throwing projectiles.
FIG. 10 is a side elevational view of the device first shown in FIG. 9 illustrating a projectile being thrown by the throwing arm.
FIG. 11 is a perspective view of the device first shown in FIG. 9 illustrating a covering and guideway for the throwing arm.

As shown in FIGS. 9–11 and 14, the projectile throwing embodiment of the device 10 includes a support stand 126 for disposition on a ground surface 128, such as an outdoor shooting range or a stretch of level pavement. The support stand 126 includes a pair of U-shaped members 130 which can be manufactured from galvanized steel tubing or heavy gauge plastic tubing. The U-shaped members 130 are connected by a plurality of crossbars 132 which will also preferably be galvanized steel tubing or heavy gauge plastic tubing. The support stand 126 could also be a plurality of spaced-apart upright posts attached to each other at their upper ends by crossbars and upon which the remaining structure of the projectile throwing version is mounted. Secured to the support stand 126 and extending upwardly therefrom is an elongated support framework 134. As shown in FIGS. 9–11, the framework 134 includes a plurality of straight metal bars 136 which extend upwardly from the support stand 126 and are spaced a slight distance from each other in the same vertical plane.

More specifically, as illustrated in FIGS. 9–11, a flat plate 138 extends between the upper ends of the U-shaped members 130. The framework 134 is mounted to the flat plate 138. In order to angle or tilt the framework 134 and alter the trajectory of the projectiles 124, a trajectory altering means is utilized. The trajectory altering means includes a pair of hinge members 140 secured to the rear edge of the flat plate 138 and which project outwardly in the same plane as the plate 138. The hinge members 140 project toward the back of the support stand 126 and each hinge member 140 includes a bore or channel (not shown) extending therethrough. One crossbar 132 extends through the bores of both hinge members 140 so that the hinge members 140 can pivot thereon. Thus, the hinge members 140 and the plate 138 can rotate or swivel as one unit on the crossbar 132 in order to tilt or angle the framework 134.

Figure 14:
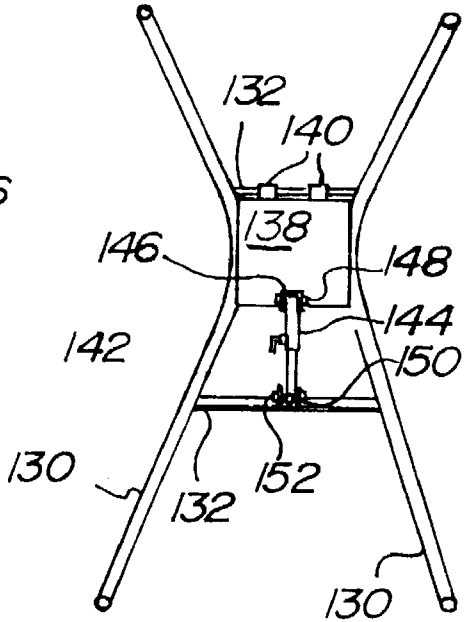
FIG. 14 is a bottom plan view of the device first shown in FIG. 9.

As shown in FIGS. 11 and 14, the mechanism that actually tilts the plate 138, the framework 134, and structural elements mounted to the framework 134 which will be hereinafter further described, is a pair of cylindrical telescoping members which are clevis-mounted to the underside of the plate 138 and the lower crossbar 132, respectively. More specifically, the cylindrical telescoping members include a smaller diameter tubing 142 inserted into a larger diameter tubing 144 and which is capable of selective linear retraction and extension within the tubing 144. The outer end of the tubing 142 is clevis-mounted to the undersurface of the plate 138 and this clevis mounting comprises a pair of spaced-apart metal ears 146 secured to the undersurface of the plate 138 and which projects downwardly therefrom. Each metal ear 146 has a drilled through-hole (not shown), and the through-holes are in axial alignment with each other. The outer end of the tubing 142 includes oppositely-disposed, axially-aligned through-holes (not shown) and, in mounting the tubing 142 to the metal ears 146, the outer end is placed between the metal ears 146 so that all of the through-holes are in alignment and then a fastener 148, such as a dowel, pin, or bolt, is inserted therethrough thus connecting the tubing 142 to the metal ears 146.

In addition, as shown in FIGS. 11 and 14, the tubing 144 is attached to the lower crossbar 132 by the same clevis-type mounting. Secured to the lower crossbar 132 are a pair of spaced-apart metal ears 150 which project toward the rear of the stand 126. Each ear 150 includes a through-hole (not shown), and the through-holes are in axial alignment with each other. The lower end of the tubing 144 includes oppositely-disposed, axially-aligned through-holes (not shown), and the lower end of the tubing 144 is placed between the ears 150 so that the holes on the ears 150 align with the holes located at the lower end of the tubing 144. A fastener 152, such as a dowel, pin, or bolt, can then be inserted therethrough thus affixing the tubing 144 to the ears 150.

Clevis mounting is used because it permits the tubing 142 and 144 to pivot or swivel on their respective fasteners 148 and 152. Adjacent the upper end of the tubing 144 is a threaded hole (not shown) which is drilled through the body of the tubing 144. A nut 154 is welded onto the surface of the tubing 144 in alignment with the threaded hole. A bolt 156 is mounted to the tubing 144 by being threaded onto the nut 154. This provides a simple arrangement for tilting or angling the framework 134 so that the trajectory of the thrown projectiles 124 can be changed.

In the normal disposition, the plate 138 will be generally horizontal and parallel to the ground surface 128 and a portion of the tubing 142 will be inserted into the tubing 144 and fixed in place by the bolt 156 being tightened through the body of the tubing 144 and down upon the cylindrical surface of that portion of the tubing 142 which is received within the tubing 144. Firmly tightening the bolt 156 against the tubing 142 fixes and holds the tubing 142 within the tubing 144. In order to tilt the framework 134 and change the trajectory of the thrown projectiles 124, the bolt 156 is loosened and drawn away from the tubing 142. The framework 134 is pivoted or tilted by the plate 138 and hinge member 140 arrangement. Depending upon whether the framework 134 is tilted forward or backward, the tubing 142 retracts within the tubing 144 or extends from the tubing 144. However, a portion of the tubing 142 should always be received within the tubing 144. When the framework 134 has been tilted or adjusted as desired by the shooters, the bolt 156 is then immediately tightened against the surface of the tubing 142 thus fixing the tubing 142 within the tubing 144 and securing the framework 134 in its adjusted disposition. The plate 138 is designed to tilt anywhere between 30° and 90° from its standard horizontal disposition.

As shown in FIGS.9–12, the framework 134 includes a plurality of supporting T-bars 158 which are attached to either of the metal bars which comprise the support framework 134 and extend outwardly therefrom. An elongated tube 160 which has an upper open end 162 and a lower open end 164 is secured to the uppermost T-bar 158 adjacent the lower end 164. The tube 160 can receive within its hollow chamber a number of projectiles 124 which exit the lower end 164 one after another as the projectiles 124 are thrown by the device 10. Located immediately beneath the lower end 164 is a funneling tube 166 which is mounted to the lower T-bar 158. The funneling tube 166 can only receive one projectile 124 at a time and helps guide the projectiles 124 in their downward path to a position where they can be thrown by the device 10.

The device as shown in FIGS. 1–5 must be slightly altered so that it can be utilized in the projectile throwing embodiment of FIGS. 9–14. While the throwing means remains the solenoid 34 and the solenoid armature 36, the linkage between the armature 36 and the throwing arm 22 has been altered. In addition, the finger 88, microswitch 42, and wire 50 shown in FIGS. 1–5 have been removed from the projectile throwing embodiment.

As shown in FIGS. 9–12, the solenoid 34 is mounted at the lower end of the framework 134 at a slight angle with respect to the ground surface 128. The armature 36 projects above the solenoid 34 and retracts or extends parallel to the framework 134. Pivotally connected to the distal end 168 of the armature 36 is a linkage member 170. Located between the funneling tube 166 and the solenoid 34 are a pair of spaced-apart throwing arm support posts 172. The posts 172 are secured to the framework 134 and project therefrom parallel to and beneath the T-bars 158. Attached to the ends of the posts 172 and extending therebetween is a fastener 174, such as a bolt. The fastener 174 is removably insertable through one post 172 and into and through the other post 172 whereupon a nut (not shown) is threaded onto the end of the fastener 174 securing the fastener 174 to the posts 172 but permitting rotatable motion of the fastener 174 on the posts 172. A small fastener 176, such as a dowel, pin, or rod, is inserted through the end of the linkage member 170 opposite the linkage member end attached to the distal end 168 of the armature 36. A finger 178 having a bent portion is mounted to the fastener 176 so that the finger 178 and the fastener 176 pivot as an integral unit.

A throwing arm 180 is pivotally attached to the framework 134 and, like the throwing arm 22 illustrated in FIGS. 1–5, the throwing arm 180 illustrated in FIGS. 9–12 is capable of selective pivotal movement from a projectile loading position to a projectile throwing position to throw one projectile 124 at a time up into the air. The throwing arm 180 can be manufactured from various materials and configured into various shapes; the throwing arm 180 utilized in the projectile throwing version is a solid piece of pvc pipe having a distal end 182 which contacts the projectile 124 during the process of throwing the projectile 124 and an attachment end 184 which is pivotally attached to the fastener 174. The finger 178 and fastener 176 are also secured to the attachment end 184—but not to the posts 172—and pivot as a result of the movement of the throwing arm 180.

Figure 12:
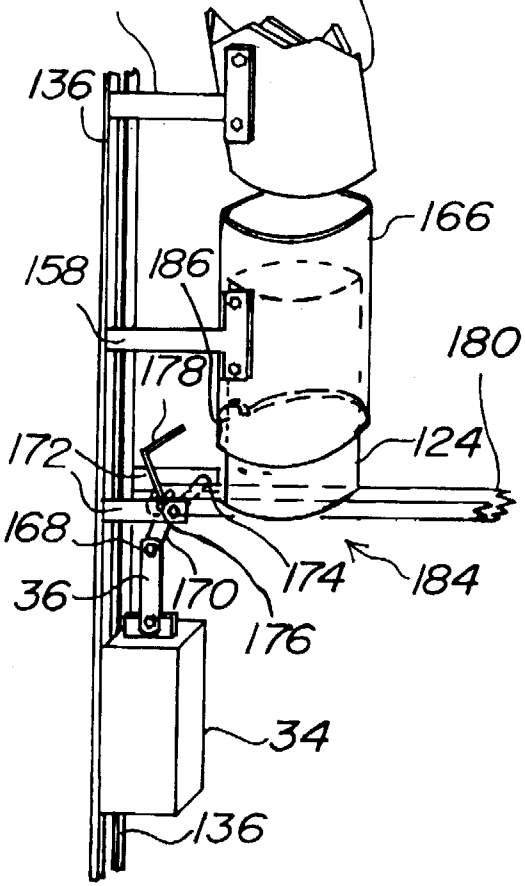
FIG. 12 is an enlarged fragmentary view of structural elements of the device first shown in FIG. 9.

As illustrated in FIG. 12, the fastener 174 is inserted through the attachment end 184 which is positioned between the support posts 172. The second end of the linkage member 170 is inserted or projects into the attachment end 184 so that the fastener 176 can be connected to the linkage member 170 and the attachment end 184, thus connecting together the attachment end 184 and the linkage member 170. Since the finger 178 is integrally attached to the fastener 176, the fastener 176 and the finger 178 pivot as one unit. Also, the fastener 176 does not rotate on the support posts 172 as does the fastener 174. When the arm 180 is in the loading position as shown in FIG. 9, the angled portion of the finger 178 extends through a half-circle cut-out 186 formed on the lower cylindrical surface of the funneling tube 166 adjacent the exit end, and the fastener 176 will be positioned above the fastener 174 at nearly twelve o'clock. The finger 178 will extend through the cut-out 186 and into the exit end of the funneling tube 166 to prevent one projectile 124 from falling through the exit end when the arm 180 is in the loading position and ready to throw an already loaded projectile 124.

As illustrated in FIGS. 9–13, the means to selectively actuate the throwing arm 180 so that the throwing arm 180 can successively throw projectiles 124 one after another is the foot switch 120. In the electrical schematic of FIG. 13, the foot switch 120 would be substituted for the microswitch 42, and the foot switch 120 would be electrically connected to the solenoid 34 by the electrical conductor 94 having a length which would permit the foot switch 120 to be placed at a distance of thirty feet—or more—from the device 10. In order to direct the falling projectile 124 to the distal end 182 of the arm 180, the device 10 includes a pair of spaced-apart channels or guide bars 188 as shown in FIGS. 9 and 10 with each bar 188 attached to the framework 134 adjacent to the support posts 172. (The bars 188 are not shown in FIG. 12 for the purpose of clarity.) The bars 188 extend at an angle downward toward the ground surface 128 and are slightly longer than the throwing arm 180. The bars 188 prevent the projectiles 124 from deviating from their downward path of travel when the finger 178 is pivoted away from the exit end of the funneling tube 166. As shown in FIG. 11, a plastic covering or container 190 can be added to completely cover both the throwing arm 180 and the bars 188 and further provide a means to faciliate the downward travel of the projectiles 124 to the distal end 182 of the throwing arm 180. The container 190 may be shaped like the bucket of an excavator or a backhoe and may also include an elongated guideway 192 which would be attached to the bottom edge of the container 190. The guideway 192 would serve as a ramp for guiding the projectiles 124 in their initial moments of flight.

In order to employ the projectile throwing version of the device 10 for practice target shooting, the first step is to find an area away from homes and residential developments and which includes a sizable field over which the projectiles 124 can be thrown and the firearms safely discharged.

The stand 126 is set on the ground surface 128 in proximity to electrical outlets and then the wires 92 and 96 are plugged into the appropriate outlets as shown in FIG. 13; depending upon the location of the outlets, extension cords may be necessary. The foot switch 120 is disposed on the ground surface 128 a distance from the stand 126; and depending upon the number of target shooters and the types of firearms that are being used, extension cords can be employed to locate the foot switch 120 much farther than thirty feet away from the stand 126. The throwing arm 180 will start off in the cocked or loading position as shown in FIG. 9 and the fastener 176 will be nearly at twelve o'clock with regard to the fastener 174 so that the angled portion of the finger 178 can extend through the half-circle cut-out 186 and into the exit end of the funneling tube 166 for restraining and preventing projectiles 124 in the tube 160 from falling therethrough. It is not necessary to manually cock the arm 180 so that the arm 180 is in the loading position. A number of projectiles 124 are loaded sequentially into the tube 160 with at least one projectile 124 falling into the funneling tube 166, but that projectile 124 is restrained and held therein by the angled portion of the finger 178. One projectile 124 can be placed upon the plate 138 and against the distal end 182 of the arm 180 as shown in FIG. 9 for permitting an extra shot.

With the projectiles 124 loaded into the tube 160 and the solenoid 34 and the foot switch 120 plugged into appropriate outlets, practice target shooting can commence. With the foot switch 120 placed on the ground surface 128, one of the practicing shooters applies pressure to the foot switch 120, thereby closing the circuit and electrically activating the solenoid 34. Immediately, the armature 36 retracts causing the fastener 176 and the finger 178 to pivot around the fastener 174 and down toward the solenoid 34. As the angled portion of the finger 178 is pivoted away from the exit end of the funneling tube 166, the projectile 24 temporarily restrained therein begins to fall downward toward the plate 138. Concomitant with the swift retraction of the armature 36 is the upward pivotal movement of the distal end 182 of the throwing arm 180. The arm 180 pivots on the fastener 174 and throws the projectile 124 already sitting within the bars 188 and on the plate 138. The arm 180 forcefully flings or throws the loaded projectile 124 up into the air to distances of approximately thirty feet or more so that the projectile 124 becomes the airborne target for the practicing shooters. When the arm 180 is at its maximum projectile throwing position, as shown in FIGS. 10 and 12, the finger 178 has been pivoted by the retraction of the armature 36 away from the exit end of the funneling tube 166, and the projectile 124 restrained within the funneling tube 166 starts falling downward toward the plate 138. Simultaneous with this projectile 124 falling through the funneling tube 166, the solenoid 34 immediately and automatically resets itself by the shooter lifting his or her foot off the foot switch 120; and thus the throwing arm 180 returns to the projectile loading position. As the arm 180 returns to the loading position, the finger 178 and the fastener 176 pivot as a unit up and around and above the fastener 174 so that the angled portion of the finger 178 extends into the cut-out 186 for preventing the next projectile 124 from falling through the funneling tube 166. Meanwhile, the projectile 124 which was already in the state of falling through the funneling tube 166 has now fallen between the bars 188 and come to rest on the plate 138 and against the distal end 182 of the throwing arm 180. The arm 180 has returned to the loading position as shown in FIG. 9 simultaneous with the projectile 124 falling into position. When the practicing target shooters are ready to shoot at another target, one of the practicing target shooters can apply pressure to the foot switch 120 and the aforedescribed actions will simply recur so this projectile 124 can be thrown into the air and shot at by the practicing target shooters. The tube 160 can be reloaded as long as the target shooters desire to practice their skills.

Although the invention herein has been described with reference to a preferred embodiment and several alternative embodiments, it is to be understood that these embodiments are merely illustrative of the principles in application of the invention. Thus, it may be understood that numerous modifications may be made in the embodiments and other arrangements may be devised without departing from the spirit and scope of the invention.

I claim:

1. A mechanical device for throwing projectiles, comprising:

an elongated base having a rear end and a front end;

a throwing arm attached to the front end of the base for receiving a ball and which is selectively pivoted from a projectile loading position to a projectile throwing position in order to throw the ball;

actuation means mounted at the rear end of the base and protruding upwardly toward the throwing arm, the actuation means being normally in a disengaged state until contact by the ball forces the actuation means to an engaged state;

throwing means for pivoting the throwing arm from the projectile loading position to the projectile throwing position and which is actuated for linear reciprocable movement by the actuation means being forced by ball contact from the disengaged state to the engaged state; and adjustment means adjacent the front end of the base for selectively varying the speed at which the throwing arm pivots from the projectile loading position to the projectile throwing position thus changing the velocity and distance to which the ball is thrown.

2. The device of claim 1 wherein the throwing means includes an electromechanical solenoid having an armature which is capable of extensible and retractable linear reciprocable movement for pivoting the throwing arm from the projectile loading position to the projectile throwing position.

3. The device of claim 2 wherein the linear reciprocable movement of the solenoid armature provides the force which pivots the throwing arm from the projectile loading position to the projectile throwing position.

4. The device of claim 1 wherein the adjustment means includes a tension spring having a first spring end secured to the front end of the base and a second spring end attached to the throwing arm.

5. The device of claim 4 wherein the adjustment means includes an elongated bolt mounted to the front end of the base and to which the first spring end is attached so that loosening or tightening the bolt relaxes or retards the linear movement of the armature when the throwing means is actuated, thus varying the distance and velocity by which the projectile is thrown.

6. The device of claim 1 wherein the throwing arm includes a projectile receiving portion which receives and temporarily holds the projectile as the arm pivots from the projectile loading position to the projectile throwing position to throw the projectile.

7. The device of claim 1 further comprising an enclosure for placement over the device and which includes an upwardly-opening slot for allowing the arm to pivot upwardly therethrough as the arm goes from the loading position to the throwing position to throw the projectile.

8. The device of claim 1 further comprising a chute disposed adjacent and above the rear end of the base and in general alignment with the arm so that the projectile can travel through the chute for placement upon the arm in order to be thrown therefrom.

9. The device of claim 1 further comprising a frame for disposition on the level surface around and above the device.

10. The device of claim 1 further comprising a basketball pole disposed adjacent to the base of the device having a lower pole end and terminating at an upper pole end.

11. The device of claim 10 further comprising a basketball backboard mounted to the pole at the upper pole end.

12. The device of claim 11 further comprising a rim secured to the backboard and projecting perpendicular therefrom, the rim spaced above and in general alignment with the chute so that the projectiles that pass downwardly through the rim will enter the chute.

13. The device of claim 12 further comprising a plurality of extensible and retractable support arms attached to the frame and capable of selective disposition above the mechanical device and around the backboard.

14. The device of claim 13 further comprising a collapsible and extensible net attached to the support arms along the length of the arms for disposition above the mechanical device so that the net can encompass the rim and collect thrown projectiles and direct the projectiles to the chute.

15. The device of claim 1 further comprising a batting cage having a first pitching end and a second open hitting end so that the device can be placed within the batting cage at the first pitching end and a practicing batter can be positioned at the second hitting end.

16. The device of claim 15 wherein the batting cage is extensible and retractable for allowing the practicing batter to be positioned at varying distances from the device.

17. The device of claim 16 further comprising a backstop disposed adjacent the second open hitting end for blocking the line of travel of projectiles thrown by the device and which are not struck by the practicing batter.

18. The device of claim 17 wherein the actuation means includes a foot switch which can be placed at varying distances from the device and which is electrically connected to the throwing means so that the practicing batter can step on the foot switch and thus actuate the throwing means to pivot the throwing arm and throw the projectile toward the batter.

* * * * *